US006903289B2

(12) United States Patent
Tongo et al.

(10) Patent No.: US 6,903,289 B2
(45) Date of Patent: Jun. 7, 2005

(54) CIRCUIT BREAKER EMPLOYING AN ILLUMINATED OPERATING HANDLE

(75) Inventors: Ernesto J. Tongo, Tamaulipas (MX); Jose I. Alarcon, Tamaulipas (MX); Percy J. Lipsey, II, Coraopolis, PA (US); Craig J. Puhalla, Moon Township, PA (US); Randal D. Gazdecki, Monaca, PA (US)

(73) Assignee: Eaton Corporation, Cleveland, OH (US)

( * ) Notice: Subject to any disclaimer, the term of this patent is extended or adjusted under 35 U.S.C. 154(b) by 118 days.

(21) Appl. No.: 10/650,342

(22) Filed: Aug. 28, 2003

(65) Prior Publication Data

US 2005/0046525 A1 Mar. 3, 2005

(51) Int. Cl.[7] ..... H01H 9/00
(52) U.S. Cl. ..... 200/310; 200/313; 335/17
(58) Field of Search ..... 200/310, 312, 200/308, 315, 317; 335/17, 132

(56) References Cited

U.S. PATENT DOCUMENTS

| | | | | | |
|---|---|---|---|---|---|
| 3,329,913 | A | | 7/1967 | Camp | |
| 3,955,162 | A | | 5/1976 | Nicol | |
| 4,151,386 | A | | 4/1979 | Nicol et al. | |
| 4,267,539 | A | | 5/1981 | Guinan | |
| 4,344,100 | A | * | 8/1982 | Davidson et al. | 361/45 |
| 4,768,025 | A | * | 8/1988 | Vila-Masot | 340/638 |
| 4,926,148 | A | | 5/1990 | Cambreleng | |
| 4,963,847 | A | | 10/1990 | Cambreleng et al. | |
| 4,969,063 | A | * | 11/1990 | Scott et al. | 361/93.1 |
| 5,546,266 | A | | 8/1996 | Mackenzie et al. | |
| 5,847,913 | A | | 12/1998 | Turner et al. | |
| 6,031,438 | A | * | 2/2000 | Runyan | 335/172 |
| 6,075,215 | A | | 6/2000 | Bollinger, Jr. et al. | |
| 6,246,304 | B1 | * | 6/2001 | Gasper | 335/17 |
| 6,342,995 | B1 | * | 1/2002 | Jones | 361/62 |
| 6,365,855 | B1 | | 4/2002 | Sutter et al. | |
| 6,542,056 | B2 | | 4/2003 | Nerstrom et al. | |

* cited by examiner

*Primary Examiner*—Kyung Lee
(74) *Attorney, Agent, or Firm*—M. J. Moran

(57) ABSTRACT

A circuit breaker includes a housing having an opening, separable contacts within the housing, and an operating mechanism for opening and closing the separable contacts. The operating mechanism includes a generally transparent operating handle having a portion protruding through the opening of the housing. An auxiliary switch associated with the operating mechanism provides a first normally closed output when the separable contacts are open and a second normally open output when the separable contacts are closed. A first LED indicator cooperates with the first output, is proximate the operating handle and is illuminated when the separable contacts are open. A second LED indicator cooperates with the second output, is proximate the operating handle and is illuminated when the separable contacts are closed. One of the first and second LED indicators illuminates the operating handle.

20 Claims, 5 Drawing Sheets

CIRCUIT BREAKER EMPLOYING AN ILLUMINATED OPERATING HANDLE

CROSS-REFERENCE TO RELATED APPLICATION

This application is related to commonly assigned, concurrently filed U.S. patent application Ser. No. 10/650,343, filed Aug. 28, 2003, entitled "Circuit Breaker Employing Illuminating Indicators for Open and Closed Positions".

BACKGROUND OF THE INVENTION

1. Field of the Invention

This invention relates generally to circuit breakers and, more particularly, to circuit breakers including an operating mechanism and an operating handle.

2. Background Information

Circuit breakers are disclosed, for example, in U.S. Pat. Nos. 3,329,913; 3,955,162; 4,151,386; 4,267,539; 4,926,148; and 4,963,847.

Hydraulic and electromagnetic circuit breakers typically comprise a movable contact, which is mounted on a movable arm, and a fixed or stationary contact. An operating handle is coupled to the movable arm via a linkage mechanism, part of which comprises a collapsible toggle assembly. The movable and stationary contacts are operated between contacts "open" and contacts "closed" positions by pivoting the operating handle. The circuit breaker further comprises a hydraulic or electromagnetic device which, in response to one or more predetermined electrical conditions, collapses the toggle assembly to a broken state, in order to trip "open" the separable movable and stationary contacts. Typically, the operating handle assumes one of two or three positions (e.g., "on", "off" and "zipped") corresponding to the contacts "closed" position, contacts "open" position, and contacts tripped "open" position.

Users who apply circuit breakers in relatively dark enclosures or other relatively dark environments desire a relatively quicker and more efficient mechanism than, for example, employing fixed or portable enclosure lighting for identifying when a circuit breaker has been turned off or tripped Otherwise, there is a "guessing game" of whether a circuit breaker is in the "on" position versus the "off" or tripped "off" position(s).

Accordingly, there is room for improvement in circuit breakers.

SUMMARY OF THE INVENTION

These needs and others are met by the present invention, which provides two illuminable indicators to indicate: (1) the "on" position (contacts "closed"); and (2) the "off" or tripped "off" positions (contacts "open" or contacts tripped "open" positions). Those indicators, in turn, are employed to illuminate the circuit breaker operating handle. Accordingly, this gives users, such as maintenance personnel, an instant indication of the circuit breaker status without having to employ, for example, fixed or portable enclosure lighting. Therefore, this permits the user to immediately locate the interrupted or otherwise opened circuit, and to reset or close the appropriate circuit breaker.

In accordance with the invention, a circuit breaker comprises: a housing including an opening; separable contacts within the housing; an operating mechanism for opening and closing the separable contacts, the operating mechanism including an operating handle having a portion protruding through the opening of the housing; means for providing a first output when the separable contacts are open and a second output when the separable contacts are closed; a first indicator cooperating with the first output of the means for providing, the first indicator being proximate the operating handle and being illuminated when the separable contacts are open; and a second indicator cooperating with the second output of the means for providing, the second indicator being proximate the operating handle and being illuminated when the separable contacts are closed, wherein one of the first and second indicators illuminates the operating handle.

The means for providing may include an auxiliary switch cooperating with the operating mechanism, the auxiliary switch having the first output and the second output.

The first indicator may be a first LED, and the second indicator may be a second LED.

The opening of the housing may include a first end and a second end. The operating handle may include a first position and a second position. The portion of the operating handle may include a first side proximate the first end of the opening in the first position and a second side proximate the second end of the opening in the second position. The first indicator may be disposed proximate the first end of the opening and proximate the first side of the operating handle in the first position thereof. The second indicator may be disposed proximate the second end of the opening and proximate the second side of the operating handle in the second position thereof.

The means for providing may include an auxiliary switch having an operating member cooperating with the operating mechanism, a common terminal, a normally closed terminal providing the first output and a normally open terminal providing the second output.

The first indicator may be a first LED including a first cathode and a first anode, and the second indicator may be a second LED including a second cathode and a second anode, which is electrically connected to the first anode of the first LED.

The opening of the housing may be a first opening. The housing may be a case including a second opening and a third opening. The first indicator may be a first LED, which protrudes through the second opening of the case. The second indicator may be a second LED, which protrudes through the third opening of the case. The first opening of the housing may include a first end and a second end. The operating handle may include a first position and a second position The portion of the operating handle may include a first side proximate the first end of the first opening in the first position and a second side proximate the second end of the first opening in the second position. The first LED may be disposed proximate the first end of the first opening and proximate the fist side of the operating handle in the first position thereof. The second LED may be disposed proximate the second end of the first opening and proximate the second side of the operating handle in the second position thereof.

The operating handle may be generally transparent and may include a first recess receiving a portion of the first LED in the first position and may include a second recess receiving a portion of the second LED in the second position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
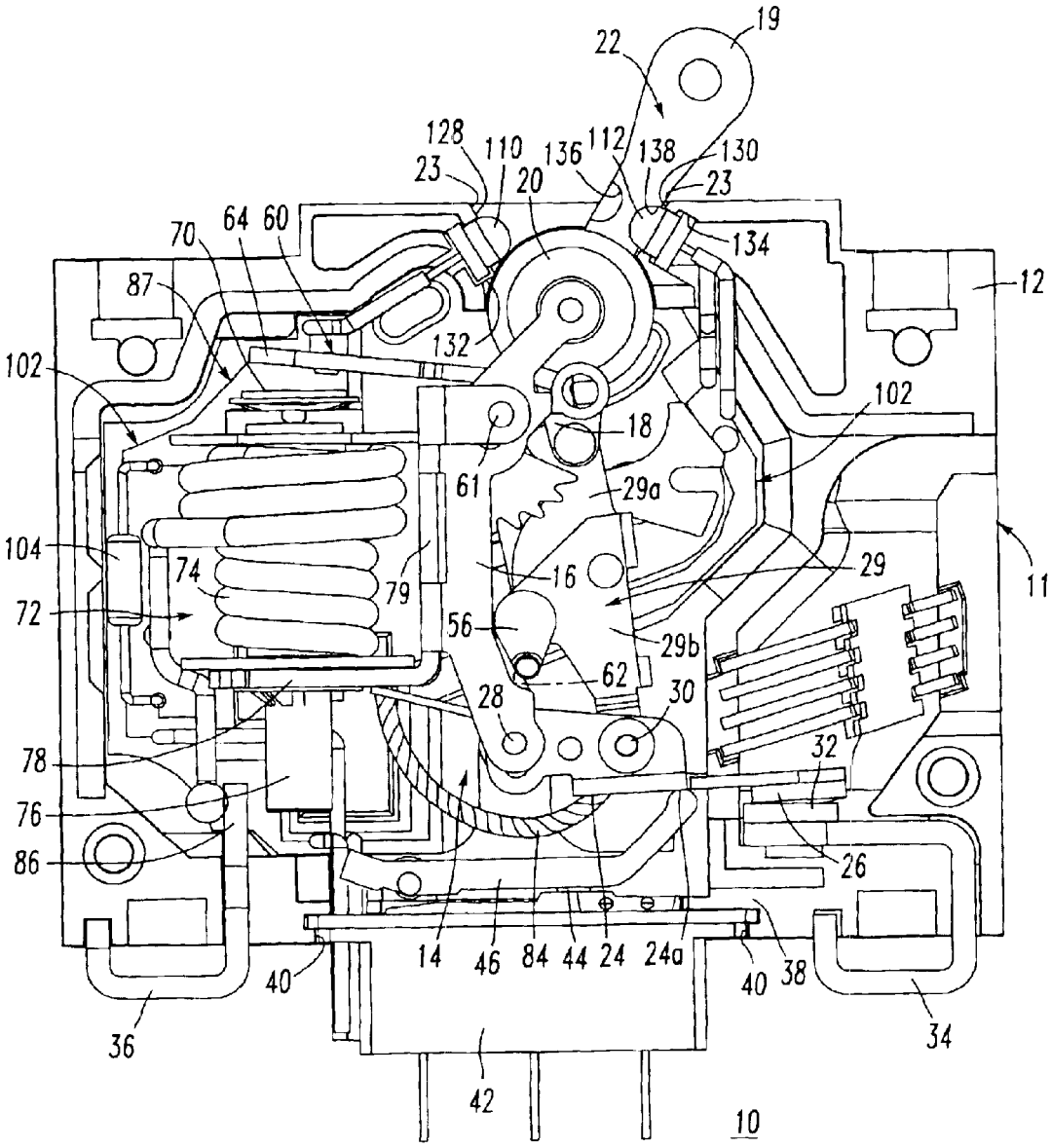
FIG. 1 is a vertical elevation view of a circuit breaker incorporating the present invention, with one-half case being removed to show the general internal arrangement and to illustrate the separable contacts in the closed position.
Figure 2:
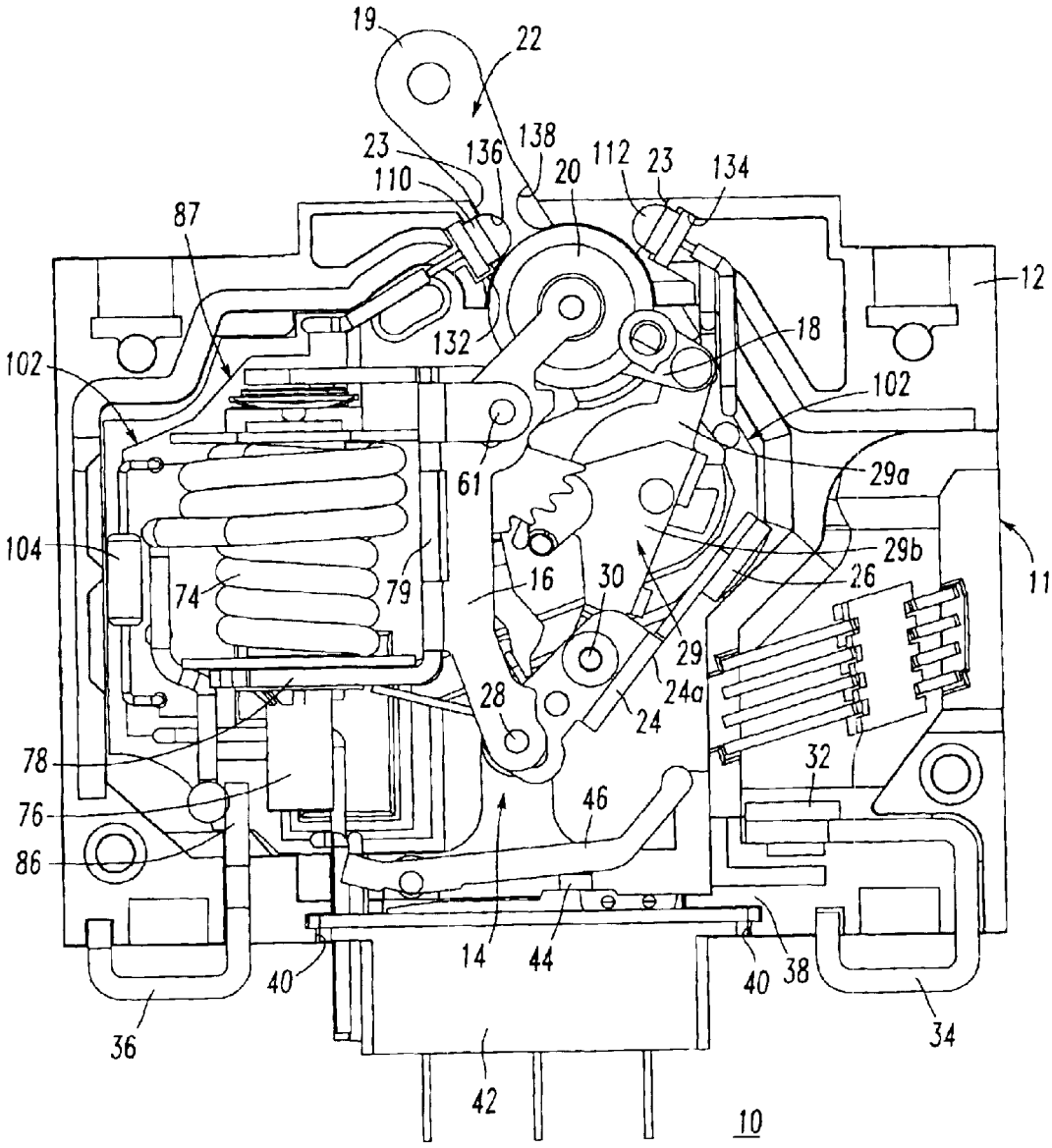
FIG. 2 is a vertical elevation view, which is similar to FIG. 1, except with the separable contacts in the open position.

Referring to FIGS. 1 and 2, the invention will be described as applied to a circuit breaker 10 for use in direct current (DC) telecommunication systems (e.g., 60 VDC; 65 VDC; 80 VDC). It will become evident that the invention is applicable to other types of circuit breakers including those used in alternating current (AC) systems operating at various frequencies; to relatively smaller or larger circuit breakers, such as subminiature or miniature circuit breakers; and to a wide range of circuit breaker applications, such as, for example, residential, commercial, industrial, aerospace, and automotive. As further non-limiting examples, both AC (e.g., 110, 120, 220, 240, 480–600 VAC) operation at a wide range of frequencies (e.g., 50, 60, 120, 400 Hz) and DC operation (e.g., 42, 60 VDC) are possible.

The circuit breaker 10 is generally similar to ones disclosed in U.S. Pat. Nos. 3,955,162 and 4,926,148, for example, which are hereby incorporated by reference herein. The circuit breaker 10 includes an insulating housing 11 formed by abutting half-cases, such as 12 (the other half-case is not shown), an operating handle 22, and terminals 34 and 36 for connecting the circuit breaker 10 to a load (not shown). The breaker operating mechanism, generally designated 14, includes a frame 16 mounted on the housing 11 and various linkages rotatably supported thereon. An actuatable member 18 is moved by an internal actuator 20 attached to the operating handle 22, wherein it is rotatably supported relative to the housing 11. The operating handle 22 also has an external portion 19 protruding through an opening 23 of the housing 11. At the other end of the housing 11 is a movable contact support 24 carrying a movable breaker contact 26 pivotally supported to rotate about a pin 28 on the frame 16. The movable contact support 24 is joined to an actuator linkage mechanism 29 by a pin 30, which allows the movable contact support 24 to be moved down (with respect to FIG. 2), in order that the movable breaker contact 26 closes against a fixed breaker contact 32 as shown in FIG. 1. The fixed contact 32 is supported on the housing half-case 12 and is electrically connected to the external terminal 34. As is discussed below, the movable contact 26 is electrically connected through a conductive circuit to the other external terminal 36. These external terminals 34,36 are the mechanism by which the breaker 10 is electrically connected into a protected circuit (not shown).

The housing 11 supports a switch receptacle 38. The half-case 12 is molded integrally with one half of the auxiliary receptacle 38 of the same resinous material. Similarly, the other half of the receptacle (not shown) is molded integrally with the other half-case (not shown). The half-cases mate to form the completed receptacle 38 when the breaker half-cases are assembled. The receptacle 38 is provided with recesses, such as 40, preferably conforming to the shape and size of an auxiliary switch 42.

The auxiliary switch 42 includes an operating member, such as a spring-loaded switch actuator, such as plunger 44. A spring (not shown) urges the plunger 44 into an extended position as shown in FIG. 2, representing one condition of the auxiliary switch 42, which corresponds to the open position of the separable contacts 26,32. When depressed inwardly against the loading of its internal spring, the plunger 44 produces the other condition of the auxiliary switch 42, which corresponds to the closed position of the separable contacts 26,32 of FIG. 1. Between the plunger 44 and the movable contact support 24 of the operating mechanism 14, and more specifically a surface 24*a* thereof, is a pivotally mounted auxiliary switch actuator member 46. The auxiliary switch actuator member 46 is designed to be moved into the plunger 44, in order to change the auxiliary switch condition. In this embodiment, the spring of the plunger 44 will return such plunger and the actuator member 46 to its rest position of FIG. 2 when the movement of the operating mechanism 14 permits.

Pivotally connected to the handle 22 is the linkage 29. The movable contact support 24 is pivotally connected to the linkage 29. The handle 22, the linkage 29 and the movable contact support 24, together with an electromagnetic tripping device or sensing element 87, jointly comprise the operating mechanism 14 of the circuit breaker 10.

The linkage 29, which includes a first link 29*a* and a second link 29*b*, is pivotally connected at its lower (with respect to FIGS. 1 and 2) end to the movable contact support 24 and at its upper (with respect to FIGS. 1 and 2) end to the handle 22.

For locking the linkage 29 in the overcenter position during automatic resetting, the linkage 29 includes a latch mechanism comprising a spring biased latch 56 carried by the second link 29*b*. The latch 56 is tripped by a pivotal armature 60 having three legs, namely, a first or unlatching leg 62, a second or attractable leg 64 and a third or substantially balancing leg (not shown). The unlatching leg 62 engages (as shown in phantom line drawing in FIG. 1) the latch 56 and turns it (counter-clockwise with respect to FIGS. 1 and 2) to unlatch the linkage 29, thereby allowing the linkage 29 to collapse under the bias of the opening spring 65 (FIG. 2) when the attractable leg 64 is pivoted sufficiently toward the pole piece 70 of an electromagnet 72 (upon predetermined overload) to bring the unlatching leg 62 into engagement with the latch 56. Further, the armature 60 pivots about a pin 61 carried by the frame 16.

The electromagnet 72 comprises a solenoid coil 74 about a tube 76, the latter projecting through a first leg 78 of the frame 16. The second frame leg 79 extends longitudinally along the coil 74, as shown. The tube 76 is of non-magnetic material and houses a movable core (not shown) of magnetizable material biased by a spring (not shown) disposed toward the lower (with respect to FIGS. 1 and 2) end of the tube 76. The moveable core is retarded in its upward (with respect to FIGS. 1 and 2) movement by a liquid, preferably a silicone oil, within the tube 76 to provide a time delay below certain overload currents before tripping of the circuit breaker 10 takes place. The coil 74 has one end connected to the movable contact support 24 by a flexible conductor 84 and the other end connected by a conductor 86 to the terminal 36. Thus, the electromagnetic tripping device or sensing element 87 is formed by the coil 74, the tube 76, the movable core within the tube 76, and the armature 60 for tripping the circuit breaker 10 after a time delay period at certain overloads or substantially instantaneously at higher overloads.

FIGS. 1 and 2 show the closed and open positions, respectively, of the operating mechanism 14, the operating handle 22 and the separable contacts 26,32. In the present circuit breaker 10, the tripped open position of the operating handle 22 is the same as the open position thereof. Alternatively, the invention is applicable to a circuit breaker (not shown) in which in a third, or tripped open position, the operating handle thereof is intermediate the on and off positions of FIGS. 1 and 2. Regardless, for the tripped open position, the linkage 29 is broken (not shown) by operation of the latch 56 and the electromagnetic tripping device or sensing element 87.

Figure 3:
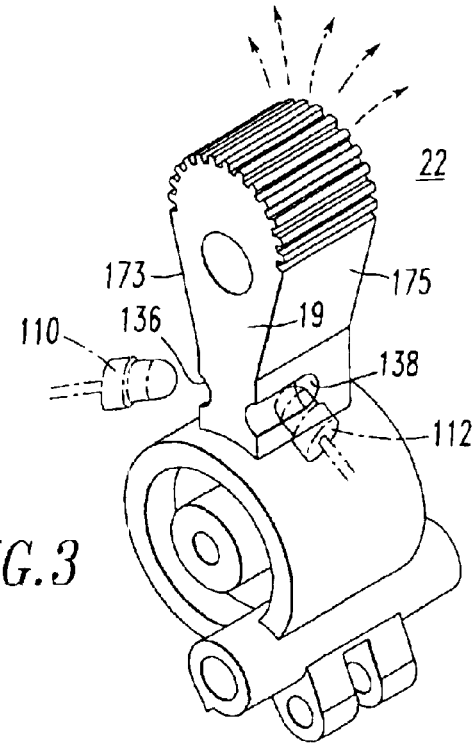
FIG. 3 is an isometric view of the operating handle of FIG. 1.
Figure 4:
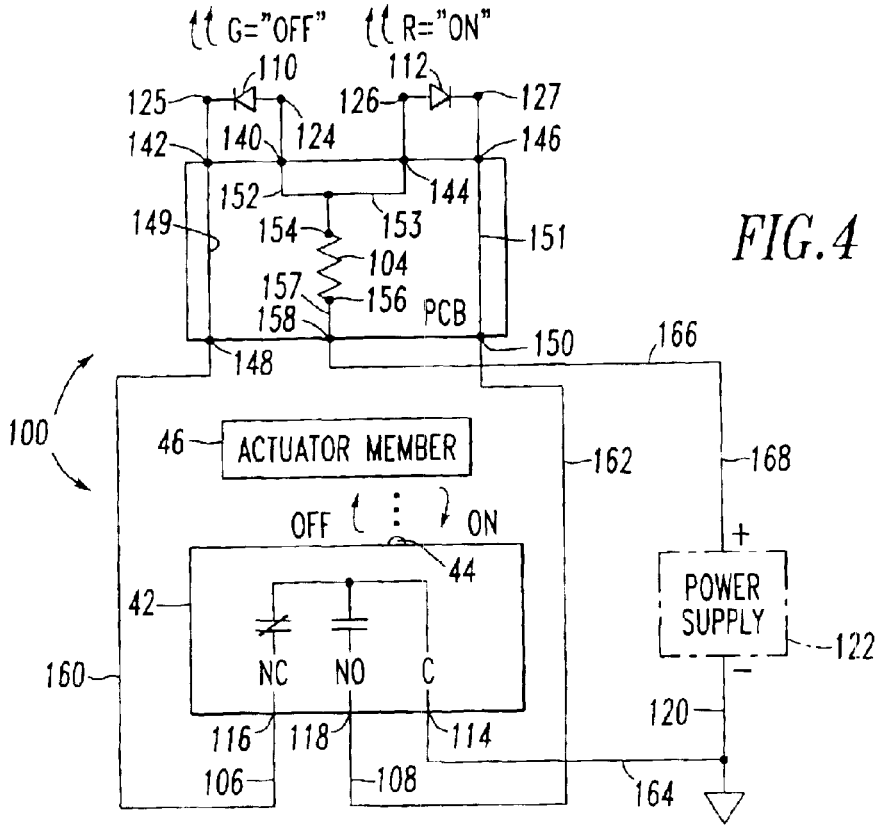
FIG. 4 is a schematic diagram showing the auxiliary switch, the LEDs, the printed circuit board electrical connections and the resistor of FIG. 1.
Figure 5:
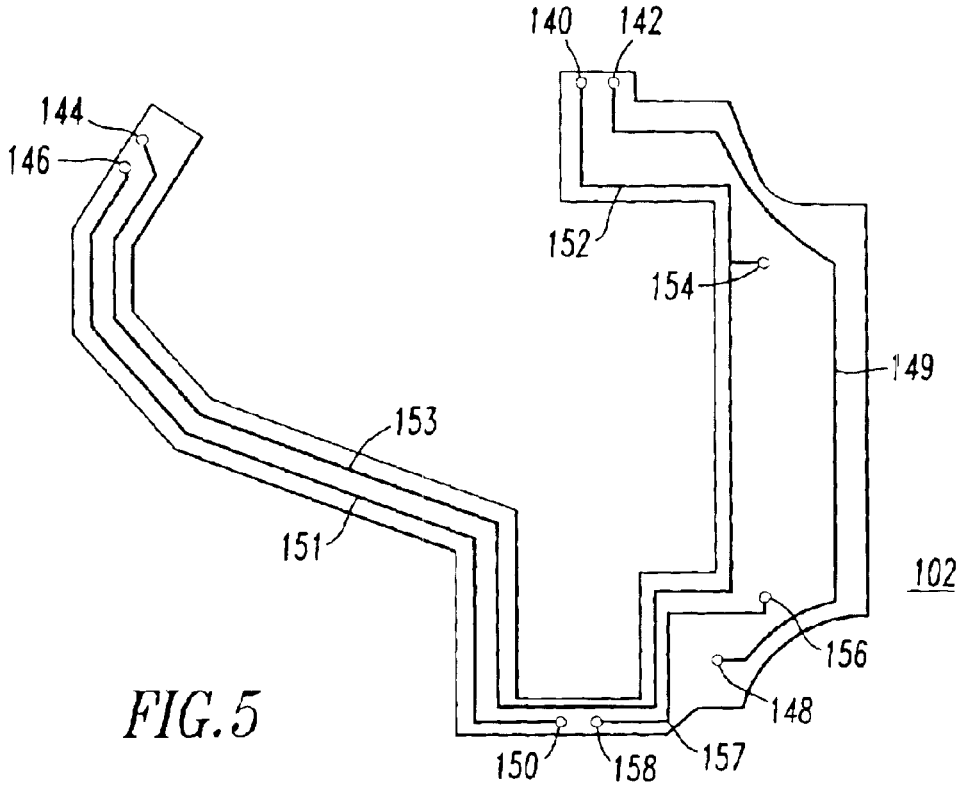
FIG. 5 is a plan view of the circuit side of the printed circuit board of FIG. 1.
Figure 6:
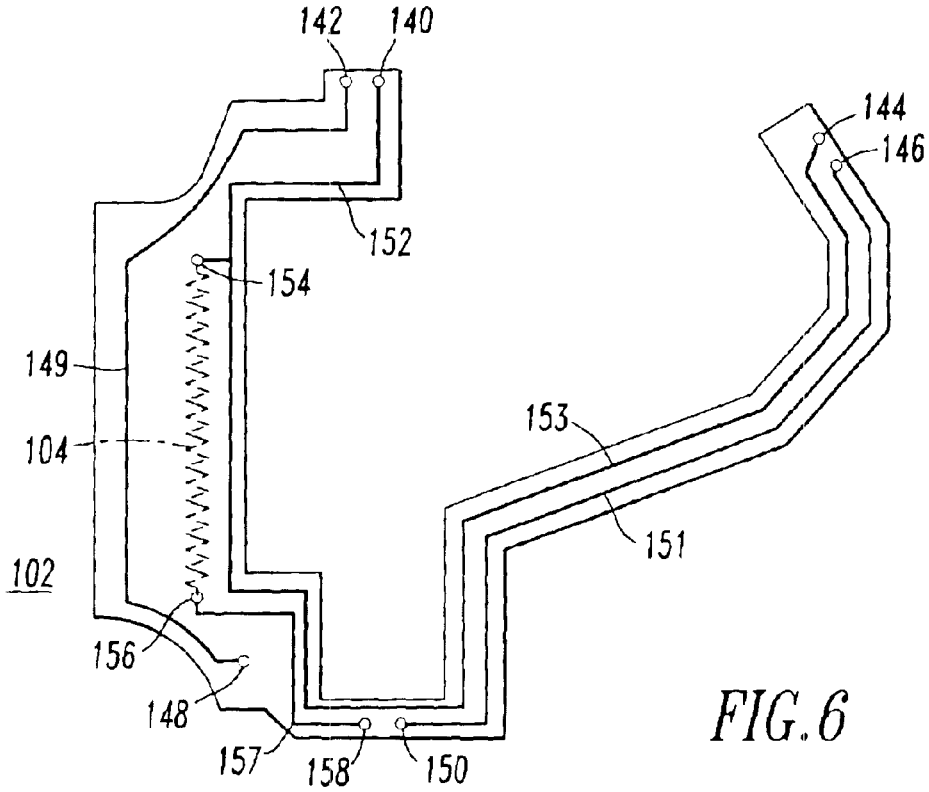
FIG. 6 is a plan view of the component side of the printed circuit board of FIG. 1.

In accordance with the present invention, as shown in FIGS. 1, 2 and 4, a circuit 100 (FIG. 4) includes the auxiliary switch 42 and a printed circuit board (PCB) 102 (as best shown in FIGS. 5 and 6) having a resistor 104. The circuit 100 provides a first output 106 when the separable contacts 26,32 are open (FIG. 2) (or tripped open) and a second output 108 when such separable contacts are closed (FIG. 1). A first indicator (e.g., an LED 110 having a first color, such as green) cooperates with the first output 106, is proximate the operating handle 22 and is illuminated when the separable contacts 26,32 are open. A second indicator (e.g., an LED 112 having a second color, such as red) cooperates with the second output 108, is proximate the operating handle 22 and is illuminated when the separable contacts 26,32 are closed. One of the first and second LEDs 110,112 illuminates the operating handle 22 (as best shown in FIG. 3). The printed circuit board 102 is suitably conformally coated with a suitable insulator, in order to electrically insulate the conductive traces thereon from internal conductive structures of the circuit breaker 10. Also, a suitable insulator (e.g., RTV) is disposed on any other exposed conductive surfaces (e.g., solder connections; resistor leads).

Continuing to refer to FIG. 4, the auxiliary switch 42 includes a common terminal 114, a normally closed (NC) terminal 116 providing the first output 106 and a normally open (NO) terminal 118 providing the second output 108. The common terminal 114 of the auxiliary switch 42 is adapted to receive a common 120 from a power source, such as a power supply 122 (shown in phantom line drawing), external to the circuit breaker 10 of FIGS. 1 and 2. In addition to the auxiliary switch common terminal 114, the first and second LEDs 110,112 include respective terminals, such as anode leads 124,126, which are adapted to be energized through the PCB 102 and the resistor 104 from the external power supply 122. As was discussed above in connection with FIGS. 1 and 2, the actuator member 46 engages and actuates the auxiliary switch plunger 44 in the closed or "on" position of the separable contacts 26,32 and is typically disengaged from such plunger in the open or "off" or tripped "off" position of such separable contacts.

Figure 7:
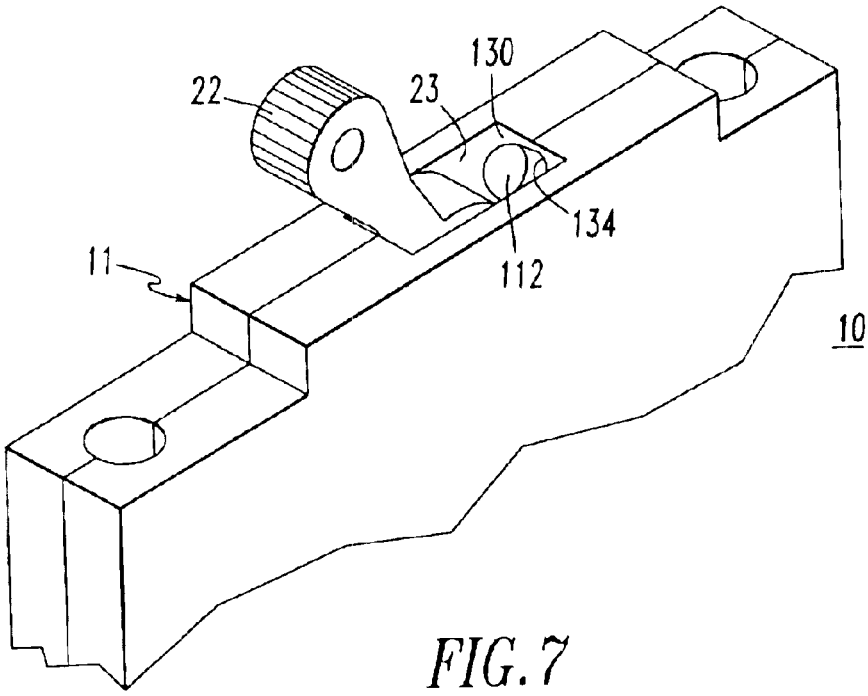
FIG. 7 is an isometric view showing the operating handle in the open position and one of the LEDs of FIG. 1.

As shown in FIGS. 1, 2 and 7, proximate the ends 128,130 of the operating handle opening 23 of the housing 11 are openings 132,134 (e.g., 3 mm) for the respective LEDs 110,112, which protrude through those respective openings.

Figure 8:
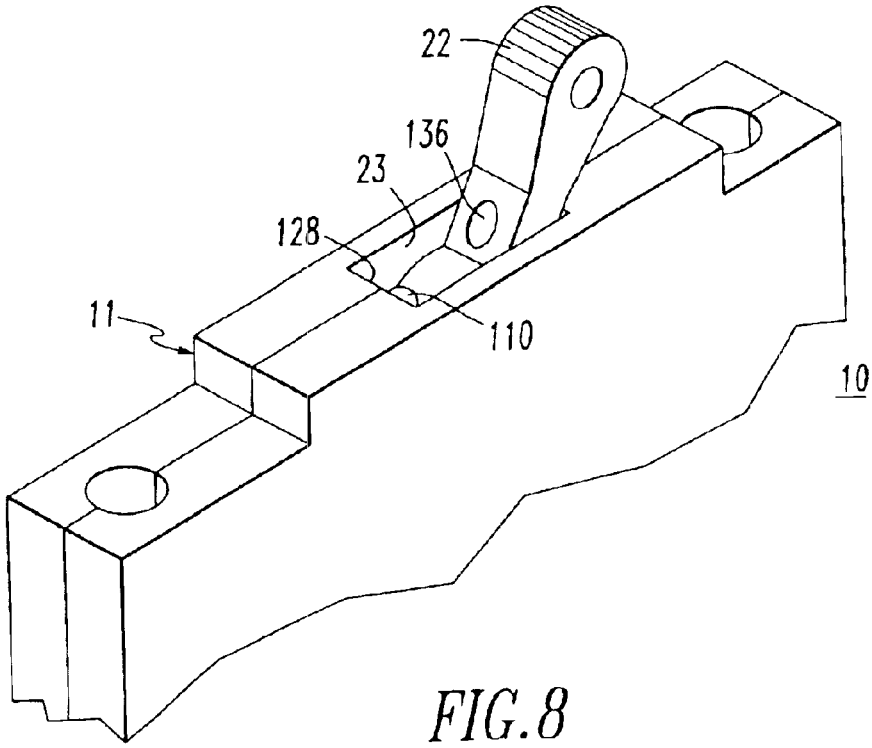
FIG. 8 is an isometric view showing the operating handle in the closed position and one of the LEDs of FIG. 1.

As shown by FIGS. 3, 7 and 8, the operating handle 22, which is preferably generally transparent, includes a first recess 136 receiving a portion of the first LED 110 in the open position of the operating handle 22 (FIGS. 2 and 7) and includes a second recess 138 receiving a portion of the second LED 112 in the closed position of the operating handle 22 (FIGS. 1 and 8).

Alternatively, in the event that a circuit breaker (not shown) employs an operating handle with an intermediate tripped open position, in that position, the first LED 110 would be set apart from, but would still generally illuminate the first recess 136 of the operating handle 22.

FIG. 4 shows the auxiliary switch 42, the LEDs 110,112 and the PCB 102, which electrically connects together the LED anode leads 124,126. The leads 124,125 of the LED 110 and the leads 126,127 of the LED 112 are directly electrically connected (or indirectly electrically connected through suitable conductors (not shown)) to plated-through component openings 140,142 and 144,146, respectively, of the PCB 102 (FIGS. 5 and 6). In turn, the PCB 102 electrically connects the component opening 142 and, thus, the cathode lead 125 of LED 110 to a plated-through component opening 148 by conductive trace 149, and electrically connects the component opening 146 and, thus, the cathode lead 127 of LED 112 to a plated-through component opening 150 by conductive trace 151. Also, two conductive traces 152,153 electrically connect the component openings 140,144 and, thus, the common LED anode leads 124,126 to a plated-through component opening 154 for the resistor 104. Another component opening 156 for the resistor 104 is electrically connected by a conductive trace 157 to a plated-through component opening 158. The component side (FIG. 6) of the printed circuit board 102 and the traces thereon are a mirror image of the circuit side (FIG. 5), except that the resistor 104, of course, is hidden from view in FIG. 5.

A first conductor 160 from the component opening 148 is electrically connected to the switch NC terminal 116. A second conductor 162 from the component opening 150 is electrically connected to the switch NO terminal 118. The switch common terminal 114 is electrically interconnected by a third conductor 164 with the common 120 of the power source 122. The component opening 158 is electrically interconnected by a fourth conductor 166 with a voltage 168 of the power source 122. Preferably, the conductors 160, 162, 164, 166 are electrically insulated. Alternatively, the conductors 164,166 may include suitable terminations (not shown) for suitable electrical connection to the external power source 122.

In this manner, the LED anode leads 124,126 are electrically connected by the printed circuit board traces 152,153 to the resistor 104, which is electrically energized by the power supply voltage 168 through the conductive trace 157, the component opening 158 and the conductor 166. The cathode lead 125 of the first LED 110 is electrically connected through the PCB 102 by the trace 149, the component opening 148 and the conductor 160 to the switch NC terminal 116. The cathode lead 127 of the second LED 112 is electrically connected through the PCB 102 by the trace 151, the component opening 150 and the conductor 162 to the switch NO terminal 118.

FIG. 7 shows the illuminated operating handle 22 in the open position along with the second LED 112, which is not illuminated. In this position, the first LED 110 (FIG. 8) is illuminated and engages the first operating handle recess 136 (as best shown in FIG. 3). Conversely, FIG. 8 shows the illuminated operating handle 22 in the closed position along with the first LED 110, which is not illuminated. In this position, the second LED 112 (FIG. 7) is illuminated and engages the second operating handle recess 138 (as best shown in FIG. 3).

The exterior portion 19 of the operating handle 22 of FIG. 3 includes a first side 173 proximate the first end 128 of the housing opening 23 in the open position, and a second side 175 proximate the second end 130 of that opening in the closed position. The first LED 110 (as shown in FIG. 8) is disposed proximate (in FIG. 7) the first end 128 of the opening 23 and proximate the operating handle first side 173 in the open position. The second LED 112 (as shown in FIG. 7) is disposed proximate (in FIG. 8) the second end 130 of the opening 23 and proximate the operating handle second side 175 in the closed position. In this manner, in either of those positions, one of the LEDs 110,112 is illuminated and engages the corresponding one of the recesses 136,138, respectively, and thus, illuminates the operating handle 22.

The two individual LEDs 110,112 are located on opposite sides of the clear operating handle 22 (e.g., made of Lexan® polycarbonate). The auxiliary switch plunger 44 toggles the auxiliary switch 42, which provides the two outputs 106,108 to the respective LEDs 110,112. The first green LED 110 illuminates when the circuit breaker 10 is "tripped" or "off", and the second red LED 112 illuminates when the circuit breaker 10 is "on". As the circuit breaker 10 is toggled between "off" (or the tripped "off") and the "on" positions, the LEDs 110,112 are toggled back and forth between the green light and the red light.

Alternatively, the operating handle 22 may be opaque (not shown) and two indicators (not shown) may be employed to illuminate corresponding exterior portions of such operating handle.

Although individual LED indicators 110,112 are disclosed, the invention is applicable to any suitable indicator(s), which may be suitably illuminated to show the open and closed positions of separable contacts, such as 26,32, and, in turn, to illuminate a circuit breaker operating handle. For example, any suitable illuminable indicator(s) and combinations thereof may be employed (e.g., a dual indicator, two individual indicators; lamp(s), light(s); any suitable illuminating device(s)).

Alternatively, a different auxiliary switch (not shown) may be employed to output to the LED indicator 110 when the separable contacts 26,32 are tripped open, and to output to the LED indicator 112 when the separable contacts are not tripped open (e.g., open or closed) with the linkage 29 being unbroken.

In the exemplary embodiment, the first indicator 110 has a first color (e.g., green; any suitable color), and the second indicator 112 has a second different color (e.g., red; any suitable color). It will be appreciated that these colors may be swapped or that a wide range of suitable colors may be employed. Alternatively, one of the indicators 110,112 may employ a suitable color, and the other one of the indicators 110,112 may employ the same suitable color, which is illuminated with a suitable on/off modulation by a suitable circuit (not shown). Alternatively, a single indicator (not shown) may be employed which is illuminated in a suitable color for one of the "on" and "off" positions, and is illuminated in the same suitable color with a suitable on/off modulation by a suitable circuit (not shown) for the other one of the "on" and "off" positions. Alternatively, a third indicator may be employed for the tripped "off" position.

Although a circuit 100 including an auxiliary switch 42 providing the outputs 106,108 is disclosed, any suitable circuit and/or mechanism may be provided in order to provide outputs corresponding to the open and closed states of separable contacts.

Although an external power source 122 is shown, the invention is applicable to circuit breakers employing a suitable internal power source (not shown).

Although the resistor 104 is employed between the common LED anodes 124,126 and the power supply voltage 168, the invention is applicable to circuits which employ a resistor between common LED cathodes and the power supply common 120.

Although a single pole circuit breaker 10 is disclosed, the invention is applicable to circuit breakers and other electrical switching devices having any count of poles and with or without a suitable trip mechanism (e.g., hydraulic; electromagnetic; magnetic; thermal).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the fill breadth of the claims appended and any and all equivalents thereof.

What is claimed is:

1. A circuit breaker comprising:

a housing including an opening;

separable contacts within said housing;

an operating mechanism for opening and closing said separable contacts, said operating mechanism including an operating handle having a portion protruding through the opening of said housing;

means for providing a first output when said separable contacts are open and a second output when said separable contacts are closed;

a first indicator cooperating with the first output of said means for providing, said first indicator being proximate said operating handle and being illuminated when said separable contacts are open; and a second indicator cooperating with the second output of said means for providing, said second indicator being proximate said operating handle and being illuminated when said separable contacts are closed, wherein said operating handle includes a first position when said separable contacts are open, a second position when said separable contacts are closed, a first surface proximate and illuminated by said first indicator in said first position when said separable contacts are open, and a second surface proximate and illuminated by said second indicator in said second position when said separable contacts are closed, said first surface being distal from said second indicator in said first position, said second surface being distal from said first indicator in said second position, and wherein one of said first and second indicators illuminates said operating handle.

2. The circuit breaker of claim 1 wherein said means for providing includes an auxiliary switch cooperating with said operating mechanism, said auxiliary switch having said first output and said second output.

3. The circuit breaker of claim 2 wherein said auxiliary switch further has an operating member cooperating with said operating mechanism, a common terminal, a normally closed terminal providing said first output and a normally open terminal providing said second output.

4. The circuit breaker of claim 3 wherein the common terminal of said auxiliary switch is adapted to receive a common from a power supply external to said circuit breaker.

5. The circuit breaker of claim 1 wherein said means for providing includes an auxiliary switch cooperating with said operating mechanism, said auxiliary switch and said first and second indicators including terminals which are adapted to be energized from a power supply external to said circuit breaker.

6. The circuit breaker of claim 1 wherein said first indicator is a first LED; and wherein said second indicator is a second LED.

7. The circuit breaker of claim 1 wherein said first indicator has a first color; and wherein said second indicator has a second different color.

8. The circuit breaker of claim 7 wherein said first color is green; and wherein said second color is red.

9. The circuit breaker of claim 1 wherein said operating mechanism includes an actuator member within said housing; and wherein said means for providing includes an auxiliary switch having a plunger cooperating with the actuator member of said operating mechanism.

10. The circuit breaker of claim 9 wherein the actuator member actuates the plunger of said auxiliary switch in the closed position of said separable contacts.

11. The circuit breaker of claim 1 wherein the opening of said housing is a first opening; wherein said housing is a case including a second opening and a third opening; wherein said first indicator is a first LED, which protrudes through the second opening of said case; and wherein said second indicator is a second LED, which protrudes through the third opening of said case.

12. The circuit breaker of claim 1 wherein said operating mechanism includes a trip unit; wherein said separable contacts include an open position, a closed position and a tripped open position; and wherein said means for providing provides said first output for the open and tripped open positions of said separable contacts, and provides said second output for the closed position of said separable contacts.

13. A circuit breaker comprising:

a housing including an opening;

separable contacts within said housing;

an operating mechanism for opening and closing said separable contacts, said operating mechanism including an operating handle having a portion protruding through the opening of said housing;

means for providing a first output when said separable contacts are open and a second output when-said separable contacts are closed;

a first indicator cooperating with the first output of said means for providing, said first indicator being proximate said operating handle and being illuminated when said separable contacts are open; and a second indicator cooperating with the second output of said means for providing, said second indicator being proximate said operating handle and being illuminated when said separable contacts are closed, wherein one of said first and second indicators illuminates said operating handle; wherein the opening of said housing includes a first end and a second end; wherein said operating handle includes a first position and a second position; wherein the portion of said operating handle includes a first side proximate the first end of the opening in the first position and a second side proximate the second end of the opening in the second position; wherein said first indicator is disposed proximate the first end of said opening and proximate the first side of said operating handle in the first position thereof; and wherein said second indicator is disposed proximate the second end of said opening and proximate the second side of said operating handle in the second position thereof.

14. The circuit breaker of claim 13 wherein said means for providing includes an auxiliary switch having an operating member cooperating with said operating mechanism, a common terminal, a normally closed terminal providing said first output and a normally open terminal providing said second output.

15. The circuit breaker of claim 13 wherein said first indicator is a first LED including a first cathode and a first anode; and wherein said second indicator is a second LED including a second cathode and a second anode, which is electrically connected to the first anode of said first LED.

16. The circuit breaker of claim 15 wherein said means for providing further includes a resistor; and wherein the first and second anodes are electrically connected to the resistor, which is adapted to be electrically energized by a voltage of a power source external to said circuit breaker.

17. The circuit breaker of claim 15 wherein said means for providing further includes a printed circuit board; wherein said first and second LEDs are operatively associated with said printed circuit board; wherein the first cathode of said first LED is electrically connected through said printed circuit board to the normally closed terminal of said auxiliary switch; and wherein the second cathode of said second LED is electrically connected through said printed circuit board to the normally open terminal of said auxiliary switch.

18. The circuit breaker of claim 15 wherein the common terminal of said auxiliary switch is adapted to receive a common from a power supply external to said circuit breaker.

19. A circuit breaker comprising:

a housing including an opening;

separable contacts within said housing;

an operating mechanism for opening and closing said separable contacts, said operating mechanism including an operating handle having a portion protruding through the opening of said housing;

means for providing a first output when said separable contacts are open and a second output when said separable contacts are closed;

a first indicator cooperating with the first output of said means for providing, said first indicator being proximate said operating handle and being illuminated when said separable contacts are open; and a second indicator cooperating with the second output of said means for providing, said second indicator being proximate said operating handle and being illuminated when said separable contacts are closed, wherein one of said first and second indicators illuminates said operating handle; wherein the opening of said housing is a first opening; wherein said housing is a case including a second opening and a third opening; wherein said first indicator is a first LED, which protrudes through the second opening of said case; wherein said second indicator is a second LED, which protrudes through the third opening of said case; wherein said first opening of said housing includes a first end and a second end; wherein said operating handle includes a first position and a second position; wherein the portion of said operating handle includes a first side proximate the first end of the first opening in the first position and a second side proximate the second end of the first opening in the second position;

wherein said first LED is disposed proximate the first end of said first opening and proximate the first side of said operating handle in the first position thereof; and wherein said second LED is disposed proximate the second end of said first opening and proximate the second side of said operating handle in the second position thereof.

20. The circuit breaker of claim 19 wherein said operating handle is generally transparent and includes a first recess receiving a portion of said first LED in the first position and includes a second recess receiving a portion of said second LED in the second position.

* * * * *